US005133471A

United States Patent [19]

Pujol Almirall

[11] Patent Number: 5,133,471

[45] Date of Patent: Jul. 28, 1992

[54] STOP DEVICES FOR CAP THREADS

[75] Inventor: Juan Pujol Almirall, Viladecans, Spain

[73] Assignee: Ultimos Desarrollos, S.A., Barcelona, Spain

[21] Appl. No.: 732,999

[22] Filed: Jul. 18, 1991

[30] Foreign Application Priority Data

Mar. 14, 1989 [ES] Spain ..... 8900826

[51] Int. Cl.[5] ..... B65D 41/04

[52] U.S. Cl. ..... 215/331; 215/252; 215/354

[58] Field of Search ..... 215/331, 354, 252

[56] References Cited

U.S. PATENT DOCUMENTS

| | | | |
|---|---|---|---|
| 1,574,085 | 2/1926 | Hammer | 215/331 |
| 1,612,449 | 12/1926 | Lee | 215/331 |
| 4,051,972 | 10/1977 | Botkin | 215/260 |
| 4,310,101 | 1/1982 | Sekine | 215/330 |
| 4,322,012 | 3/1982 | Conti | 215/344 |
| 4,519,518 | 5/1985 | Wiles et al. | 215/331 |
| 4,638,917 | 1/1987 | Persch | 215/252 |
| 4,664,279 | 5/1987 | Obrist et al. | 215/252 |

*Primary Examiner*—Stephen P. Garbe
*Assistant Examiner*—Stephen Cronin
*Attorney, Agent, or Firm*—Darby & Darby

[57] ABSTRACT

The stop device for cap threads is preferably applicable to plastic caps which are coupled by screwing on the corresponding neck of a bottle containing liquids.

The device consists of a thickening or projection (8) provided in the inner part of the cap (1), specifically in the intersection part between the side surface of said cap and the bottom of the same. When the cap (1) is screwed on the neck of the bottle this thickening (8) stops against the first thread (2') which the neck of the bottle has, constituting an obstacle resistant enough to prevent the cap (1) in its last screwing phase from continuing screwing on the neck.

8 Claims, 1 Drawing Sheet

STOP DEVICES FOR CAP THREADS

This is a continuation of application Ser. No. 492,977, filed Mar. 12, 1990 now abandoned.

BACKGROUND OF THE INVENTION

1. Field of the Invention

The present invention relates to a stop device for cap threads, which has been conceived and made in order to prevent the cap from screwing beyond some pre-established limits.

The stop device is applicable to the type of caps made out of plastic and which screw on a neck of bottles which preferably contain carbonated products, such as soft drinks and the like.

2. Description of the Related Art

By exerting a moderate rotating force while screwing a plastic cap onto a bottle neck, the resistance of the threads of the bottle and of the cap itself becomes exceeded after reusing the cap several times and the so-called state of a "crossed thread" is reaohed. Thus, the cap and the bottle become useless. Further, on occasions the contents or the carbon dioxide leak and this has corresponding negative consequences.

In view of this, some standards of quality were set down which should be met by this type of cap. These standards of quality established some minimal forces which all caps used to seal bottles for liquids should resist.

Now then, due to the nature of the material used to make caps, it is unquestionable that at certain temperatures the required standards of quality can be met on the basis of a specific size and design of the cap. Above a certain temperature, and due to the nature of the material, the same force as before will now cause in these conditions of higher temperature the thread to no longer fit properly.

Therefore, cap manufacturers have been forced to oversize the whole and this involves technical and economic inconvenience.

SUMMARY OF THE INVENTION

The cap of the invention includes a stop device which definitively solves the problems cited above and all of this without the temperature having an influence on the greater or lesser effectiveness of the system.

In this sense, the stop that the cap has remains placed at the pitch of the thread of the neck of the bottle, preventing the cap from continuing to screw before a side overforce on the threads is reached.

The stop device is applicable to plastic caps, and specifically to those that form a cap type body with an inner thread for its coupling to the inner thread of the bottle. The cap is conveniently provided on its bottom edge with the respective sealing ring, which includes a tooth which interlocks in a transversal rib of the bottle.

Likewise, this cap has an inner ring-shaped flange or partition for its adjustment to the mouth of the bottle. In other words, the top edge of the bottle remains inserted between the flange or ooncentric partition and the side surface of the oap.

As to the stop device itself, the same consists of a thickening located in the inner contour of the cap, preferably in correspondence with the inner edge established between the bottom and the flap or inner flange of the cap. This is all for the purpose of keeping the thickening placed at the pitch of the first single thread of the neck of the bottle. The thickening determines an obstaole resistant to the turning of the cap in the last screwing phase.

Preferably, the stop covers an arc of approximately 75° and its inner radius has to be less than half of the outer diameter of the thread of the neck of the bottle.

In order to complement the description which is going to be made hereinafter and for the purpose of providing a better understanding of the characteristics of the invention, reference is made to the accompanying drawings and following description.

DESCRIPTION OF THE PREFERRED EMBODIMENT

Figure 1:
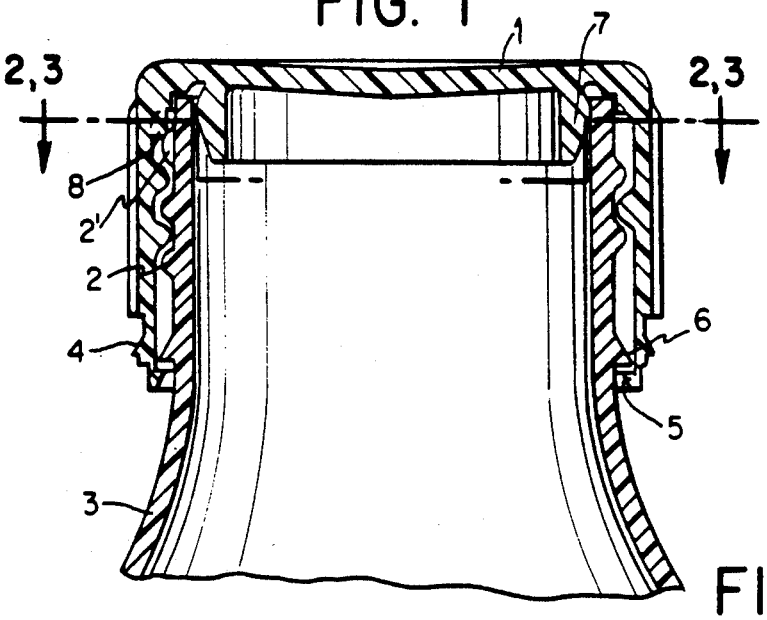
FIG. 1 shows a sectional view, according to a vertical and diametrical plane of the cap coupled to the neck of a bottle. The oap includes the stop device made in accordance with the invention.

FIG. 1 shows a plastic cap 1 that is screwed on the oorresponding single thread 2 provided on the neck of a bottle 3, with the particular feature that the latter is to contain liquids, such as soft drinks or the like.

The cap is conventionally complemented, in correspondence with its bottom edge, with a sealing ring 4 provided with a ring-shaped tooth 5, which interlooks in the transversal rib 6 of the bottle 3. In the bottom of the cap there is a flap or concentric partition 7, between which and the inside side surface of the cap fits the top edge of the neck of the bottle 3.

Figure 2:
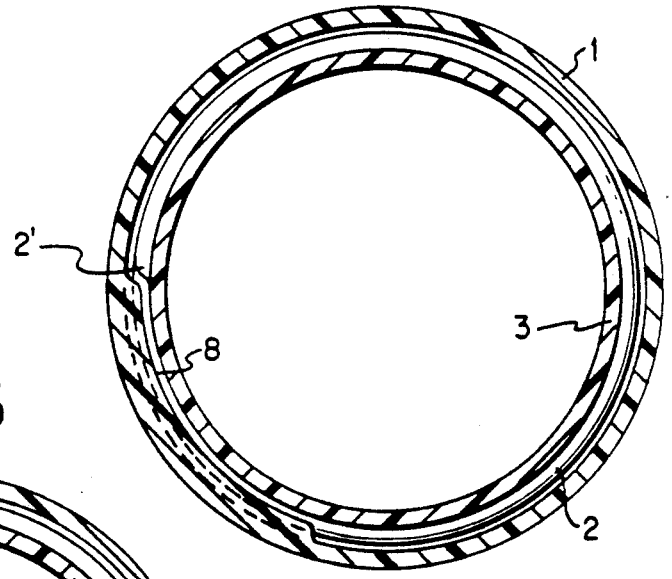
FIG. 2 shows a ,sectional view, in acoordance with a horizontal plane across section lines 2—2 of FIG. 1, in other words, perpendicular to the axial axis of the whole which constitutes the coupling between the cap and the neck of the bottle, prior to engagement.

The stop device consists of a thickening 9 provided in correspondence with the inner contour of the cap 1, preferably in the inner edge established between the bottom and the flap or concentric partition 7, as one oan see very well in the left part of FIGS. 1 and 2.

Figure 3:
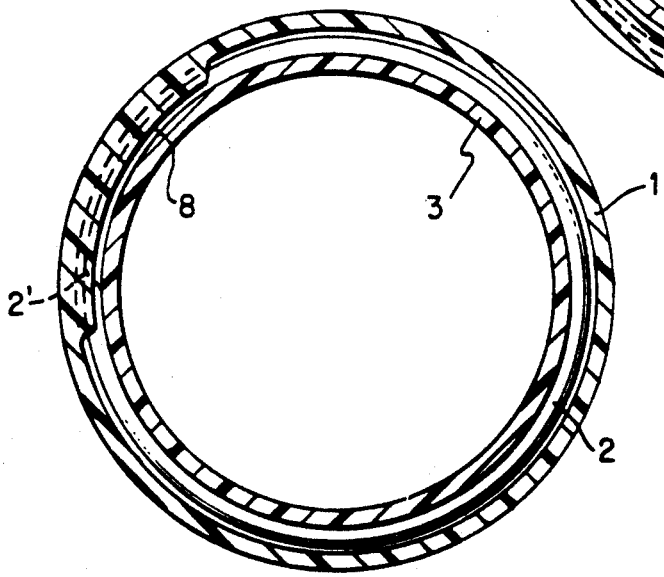
FIG. 3 shows a sectional view as in FIG. 2 across section lines 3—3 of FIG. 1, but after engagement.

FIG. 3 shows engagement of the thickened portion 8 and bottle neck thread portion 2, along most of the length of the thickened portion 8.

The thickening 8 is placed at the pitch of the first section 2' of the thread 2 of the neck of the bottle 3, determining an obstacle resistant to the turning of the cap in the last screwing phase. Further, this thickening 8 covers an arc of approximately 75° and has a bottom inner radius half the outer diameter of the thread 2 of the neck of the bottle 3.

In this way, when the cap 1 is screwed on the neck of the bottle 3, a point will be reaohed in which the first section of the thread 2' will be at the thickening 8, impeding its advance until reaching a resistance such that the force needed to continue screwing on the cap by hand exceeds that which is established as the quality standard.

In order to reach such a resistance, it follows that the thickened portion or thickening 8 engages an inoreasing area of the bottle thread as the oap oontinues to be screwed onto the bottle neck beyond an extent of threadable engagement where sealing takes place. As engagement of this increasing area takes place, resistance increases against further turning of the cap on the bottle neck until reaching the resistance which satisfies the standard of quality, e.g., that which prevents the cap from reaching a relative position on the bottle neck where the cap and bottle threads would be in a crossed thread state.

Logically, the force is borne only by the thickening 8 and by the first section 2' of the thread 2 corresponding to the bottle 3, all in such a way that the threads of the bottle and of course the ones of the cap will not bear any side overpressure. This attains an indefinite duration of the sealing of the cap and a guaranteed conserving of the contained liquid, also avoiding all risks of leakage.

I claim:

1. An apparatus which impedes screwing beyond an extent of threading engagement, comprising:

a cap threaded inside at a pitch that is threadably engageable with a pitch of an engaging thread on a bottle neck;

means for sealing said cap to a mouth of a bottle as soon as said cap threadably engages said bottle neck by an extent of threadable engagement, said cap being manually screwable further onto said bottle neck beyond said extent; and means for impeding further screwing of said cap onto said bottle neck when screwing beyond said extent, said impeding means including a thickened portion projecting from said cap into a position where said thickened portion engages an increasing area of the thread on the bottle neck as said cap continues to be screwed beyond said extent so as to increase resistance against further turning of said cap on said bottle neck until reaching a resistance which prevents said cap from being manually turned any further and which prevents said cap from reaching a relative position on said bottle neck where said cap and bottle threads would be in a crossed thread state.

2. An apparatus as in claim 1, further comprising a sealing ring on said cap and a transverse rib on said bottle neck which sealingly engage each other as soon as said extent of said threadable engagement is reached.

3. An apparatus as in claim 2, wherein said sealing ring includes a ring-shaped tooth which engages with said transversal rib.

4. An apparatus as in claim 2, wherein said thickened portion extends about an inner circumference of said cap by an arc of approximately 75 degrees, said thickened portion having an inner radius which is less than half an outer diameter of the thread on the bottle neck.

5. An apparatus as in claim 2, where said cap includes base and skirt portions, said skirt portion extending from said base portion, said threads of said cap being on said skirt portion, said sealing means including a flange which projects from said base portion at a location radially inside of said skirt portion, said flange being against an inner circumference of a mouth of the bottle neck as said cap is screwed onto said bottle neck to said extent.

6. An apparatus as in claim 1, wherein said cap includes base and skirt portions, said skirt portion extending from said base portion, said threads of said cap being on said skirt portion, said sealing means including a flange which projects from said base portion at a location radially inside of said skirt portion.

7. An apparatus as in claim 6, wherein said thickening extends between said skirt portion and said flange.

8. An apparatus as in claim 1, wherein said thickened portion extends about an inner circumference of said cap by an arc of approximately 75 degrees.

* * * * *

UNITED STATES PATENT AND TRADEMARK OFFICE

CERTIFICATE OF CORRECTION

PATENT NO. : 5,133,471

DATED : July 28, 1992

INVENTOR(S) : Juan Pujol Almirall

It is certified that error appears in the above-indentified patent and that said Letters Patent is hereby corrected as shown below:

On the title page:

After "[22] filed: Jul. 18, 1991" insert the following:

--[62] Related U.S. application data
Continuation of Ser. No. 492,977,
Mar. 12, 1990, abandoned--

Signed and Sealed this
Fifteenth Day of March, 1994

Bruce Lehman

BRUCE LEHMAN

*Commissioner of Patents and Trademarks*

*Attest:*

*Attesting Officer*